US006409585B1

(12) United States Patent
Oowada

(10) Patent No.: US 6,409,585 B1
(45) Date of Patent: Jun. 25, 2002

(54) POLISHING APPARATUS AND HOLDER FOR HOLDING AN ARTICLE TO BE POLISHED

(75) Inventor: Shin Oowada, Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/468,307

(22) Filed: Dec. 21, 1999

(30) Foreign Application Priority Data

Dec. 21, 1998 (JP) ..... 10-363465
Apr. 9, 1999 (JP) ..... 11-102613

(51) Int. Cl.[7] ..... B24B 41/06

(52) U.S. Cl. ..... 451/364; 451/285; 451/287; 451/385; 451/398

(58) Field of Search ..... 451/364, 385, 451/398, 287, 285

(56) References Cited

U.S. PATENT DOCUMENTS 4,944,119 A 7/1990 Gill, Jr. et al.
5,868,609 A * 2/1999 Aaron et al.
5,899,798 A * 5/1999 Trojan et al.
6,024,633 A * 2/2000 Kimura et al.

FOREIGN PATENT DOCUMENTS

JP 10-217111 8/1998

* cited by examiner

*Primary Examiner*—Joseph J. Hail, III
*Assistant Examiner*—Willie Berry, Jr.
(74) *Attorney, Agent, or Firm*—Wenderoth, Lind & Ponack, L.L.P.

(57) ABSTRACT

This invention pertains to a substrate holding apparatus comprising a substrate holder having a center axis for rotation and adapted to hold a substrate to be polished and urge the substrate against a polishing pad, a drive shaft for drivingly rotating the substrate holder about the center axis, and a joint for connecting the substrate holder to the drive shaft in such a manner that the substrate holder can tilt relative to the joint. The substrate holder includes a substrate holding member and a cover member placed on and secured to the substrate holding member. The substrate holding member has a lower surface for holding the substrate and an upper surface having a curved surface recess with an opening at the upper surface and a center bottom portion which is the deepest in the recess. The cover member has a lower surface with a projected portion inserted into the curved surface recess and an upper surface having a recess extending towards the projected portion and having a bottom surface through which the axis of rotation of the substrate holder vertically extends. The joint is provided at the bottom of the recess of the cover member.

48 Claims, 8 Drawing Sheets

POLISHING APPARATUS AND HOLDER FOR HOLDING AN ARTICLE TO BE POLISHED

BACKGROUND OF THE INVENTION

The present invention relates to a polishing apparatus and, more particularly, to an apparatus for holding an article to be polished, for example, a semiconductor wafer. With recent rapid progress in technology for fabricating high-integration semiconductor devices, circuit wiring patterns and interconnections have been becoming increasingly fine, with spaces between wiring patterns decreasing. As wiring spacing decreases to less than 0.5 microns, the depth of focus in circuit pattern formation in photolithography or the like becomes shallower. Accordingly, surfaces of semiconductor wafers on which circuit pattern images are to be formed by a stepper require a higher degree of surface flatness.

FIG. 1 shows a conventional polishing apparatus for making the surface of a semiconductor wafer flat. The apparatus includes a polishing table 4 provided with a polishing cloth 2, for example, bonded thereto to form a polishing surface. The apparatus further includes a substrate holding apparatus 6 for holding a substrate W to be polished, for example a semiconductor wafer. An abrasive liquid Q is supplied between the polishing surface and a surface of the substrate W to be polished from an abrasive liquid supply pipe 8, and the substrate W is pressed against the polishing surface under a predetermined pressure by the substrate holding apparatus 6, while the polishing surface and the substrate W are caused to slide relative to each other to thereby effect polishing.

A typical substrate holding apparatus includes, as shown in FIG. 2, a substrate holder 10 and a drive shaft 12 connected to the substrate holder 10 at the lower end thereof through a universal joint 14. The drive shaft 12 is adapted to transmit a rotational torque and a pressing force to the substrate holder 10 through the universal joint. The substrate holder 10 is also allowed to pivot about the universal joint 14. The substrate holder 10 includes a substrate holding member 16 and a cover member 18 placed on and fastened to the substrate holding member 16 with a clearance or gap S being formed therebetween. The substrate holding member 16 is adapted to hold a substrate W against its lower surface under the influence of a vacuum generated in the substrate holder 10 and against the substrate. Over the substrate holding member 16 and the cover member 18 there is provided an annular pressure member 20 to impose a downward pressure thereon. The substrate holding member 16 is provided along its outer periphery with a guide ring 22 to cooperate with the substrate holding member to define a recess for receiving the wafer W.

The upper surface of the substrate holding member 16 has a center recess 24 and an annular step surface 26 surrounding the recess 24. The cover member 18 has on its lower surface a centrally projecting portion 28 for engagement with the center recess 24 of the substrate holding member 16 and has along its outer periphery an annular flange 30 to be fastened to the step surface 26 of the substrate holding member 16 using bolts. The cover member 18 also has on its upper surface an annular projection 34 positioned in coaxial relation therewith, and a recess 32 surrounded by the annular projection 34. A rubber sheet 37 is provided between a step surface 36 of the cover member 18 and the flange 30 to seal the gap S.

The gap S is fluidly connected to a fluid connection path 40 formed in the pressure member 20, a fluid connection structure (not shown), and to the lower surface of the substrate holding member 16 through a plurality of holes 38 vertically extending through the substrate holding member 16. The fluid connection path 40 is adapted to be selectively connected to a vacuum source and a pressurized fluid source (not shown) so that a vacuum and pressurized fluid are selectively applied to the lower surface of the substrate holding member 16.

The drive shaft 12 has a drive member 68 with a flange portion 66 extending radially outwardly therefrom. The universal joint 14 is provided between the drive member 68 and the cover member 18, and about which the substrate holder 10 tilts while a force is transmitted to the substrate holder 10. The universal joint 14 includes a spherical bearing 70 and a rotation transmission device 72 for transmitting a rotational drive force to the substrate holder 10 from the drive shaft 12.

The spherical bearing 70 includes a ball bearing 78 and hemispherical recesses 80, 82 formed respectively at the center of a projected portion 76 formed on the lower surface of the drive member 68 and at the center of the recess 32 formed in the upper surface of the cover member 18, with the hemispherical recesses slidably receiving the ball bearing 78. The lowest point of the ball bearing 78 received in the hemispherical recess 82 is positioned below the step surface 26 of the cover member 18. Due to the provision of the recess 24 in the substrate holding member 16 and the projected portion 28 of the cover member 18, the thickness of the substrate holder 10 is able to be made smaller. Further, the positioning of the universal joint 14 in the recess 32 of the cover member 18 makes it possible to position the spherical bearing 70 close to the turntable 4.

However, it is desired to provide the spherical bearing 70 at a position much more closer to the turntable 4 in order to decrease the amount of rotational moment around the spherical bearing 70 generated by a friction force acting between the substrate W and the turntable 4 and imposed on the substrate holder 10 during a polishing operation, to enable a stable polishing operation.

Since a magnitude of the rotational moment is proportional to a distance between the spherical bearing 70 and the substrate W, it may be possible to decrease the magnitude by increasing the depth of the recess 32. However, this leads to a decrease in rigidity of the substrate holding member 16 with the result that the substrate holding member 16 becomes susceptible to deformation under the influence of a pressing force transmitted through the spherical bearing 70 and, as a result, it becomes difficult for a substrate to be appropriately flattened.

In particular, with an increase in size of wafers there is a concomitant increase in the amount of heat generated during a polishing operation, with the heat being transferred from the wafer to the wafer holder. Due to the large-size of the substrate holder, the mass thereof is greatly increased, however, a surface thereof from which heat is discharged is not greatly increased. As a result, the heat accumulated in the substrate holder has an adverse influence on the polishing operation.

The amount of heat generated at the center area of a substrate W is greater than that generated at the periphery of the same, and consequently a temperature gradient exists with respect to the substrate along its radial direction with the result that the heat transmitted to the substrate holding member 16 increases with a corresponding gradient. It is therefore necessary for the substrate holding member 16 to be resistant to and capable of readily discharging heat. One of the easiest ways of meeting this requirement is to decrease the mass of the substrate holding member 16.

Further, it is necessary for the substrate holding member 16 to be periodically disassembled from the substrate holder 10 in order to renew a substrate holding pad provided on the lower surface of the substrate holding member and/or to clean the substrate holding member. It is desirable from an operator's point of view to provide a substrate holding member which is not too heavy. As substrates have have become larger in recent years, the weight of holders has become a significant problem.

This invention is made in the light of the above-stated circumstances.

SUMMARY OF THE INVENTION

An object of this invention is to provide a substrate holding apparatus comprising a substrate holder having a center axis for rotation and adapted to hold a substrate to be polished and urge the substrate against a polishing pad, a drive shaft for drivingly rotating the substrate holder about the center axis, and a joint for connecting the substrate holder to the drive shaft in such a manner that the substrate holder can tilt relative to the drive shaft, the substrate holder includes a substrate holding member and a cover member placed on and secured to the substrate holding member. The substrate holding member a lower surface for holding the substrate and an upper surface having a curved surface recess with an opening at the upper surface and a center bottom portion which is the deepest in the recess. The cover member has a lower surface with a projected portion inserted into the curved surface recess, and an upper surface having a recess extending towards the projected portion and having a bottom surface through which the axis of rotation of the substrate holder vertically extends. The joint is provided at the bottom of the recess of the cover member.

The recess of the cover member may extend into the projected portion so that the bottom portion thereof is positioned below the level of the opening formed in the upper surface of the substrate holding member.

The curved surface recess may have a vertical cross section configuration represented by a curve of the second order such as an oval, a circle and so on.

It is preferable that the difference between a moment of inertia relative to a reference axis passing through the joint and a moment of inertia relative to an axis parallel to the reference axis and passing through the center of gravity of the substrate holder is in the range of ±5% of the latter moment of inertia.

The projected portion of the cover member may be formed in a complementary fashion relative to the curved surface recess.

Another object of this invention is to provide a substrate holding apparatus comprising a substrate holder having a center axis for rotation and adapted to hold a substrate to be polished and urge the substrate against a polishing pad, a drive shaft for drivingly rotating the substrate holder about the center axis, and a joint for connecting the substrate holder to the drive shaft in such a manner that the substrate holder can tilt relative to the drive shaft. The substrate holder includes a substrate holding member having a lower surface for holding the substrate and an upper surface. The cover member has a lower surface opposing the upper surface of the substrate holding member and an upper surface connected to the joint. The substrate holding member and the cover member are fastened to each other via a first set of bolts which are arranged at a predetermined interval along a first circle coaxial with the axis of rotation, and a second set of bolts which are arranged at a predetermined interval along a second circle coaxial with and radially outside of the first circle.

The bolts of at least one of the first and second sets may be inclined from a vertical orientation.

The bolts of one the first and second sets may be tightened with a torque to provide an appropriate mechanical connection strength between the substrate holding member and the cover member, and the bolts of the other set may be tightened so as to adjust flatness of the lower surface of the substrate holding member.

It is preferable that the upper surface of the substrate holding member is provided with a curved surface recess having an opening formed in the upper surface, the lower surface of the cover member is provided with a projected portion the configuration of which is complementary to the curved surface recess of the substrate holding member and, the bolts inclined from the vertical orientation are arranged along a circle, the diameter of which is smaller than that of the opening so that the bolts extend substantially normal to opposing surfaces of the curved surface recess and the projected portion of the cover member.

A further object of this invention is to provide a substrate holding apparatus comprising a substrate holder having a center axis for rotation and adapted to hold a substrate to be polished and urge the substrate against a polishing pad, a drive shaft for drivingly rotating the substrate holder about the center axis, and a joint for connecting the substrate holder to the drive shaft in such a manner that the substrate holder can tilt relative to the drive shaft. The substrate holder includes a substrate holding member having a lower surface for holding the substrate and an upper surface. The cover member has a lower surface opposing the upper surface of the substrate holding member and an upper surface connected to the joint. The substrate holding member and the cover member are fastened to each other via a plurality of bolts which are arranged at a predetermined interval along a circle coaxial with the axis of rotation and are inclined from a vertical orientation.

It is preferable that the upper surface of the substrate holding member is provided with a curved surface recess having an opening formed in the upper surface, the lower surface of the cover member is provided with a projected portion the configuration of which is complementary to the curved surface recess of the substrate holding member, the bolts inclined from the vertical orientation are arranged along a circle, the diameter of which is smaller than that of the opening so that the bolts extend substantially normal to opposing surfaces of the curved surface recess and the projected portion of the cover member, and the projected portion of the cover member is provided on its surface with cylindrical projections provided in such a manner that each cylindrical projection surrounds the corresponding one of the bolts inclined from the vertical orientation and abuts the surface of the curved surface recess of the substrate holding member so as to form a clearance between the surface of the projected portion of the cover member and the curved surface of the curved surface recess.

The above and the other objects, features and advantages of this invention will become more apparent from the following description of the preferred embodiments thereof, taken in conjunction with the accompanying drawings.

DETAILED DESCRIPTION OF THE INVENTION

Figure 1:
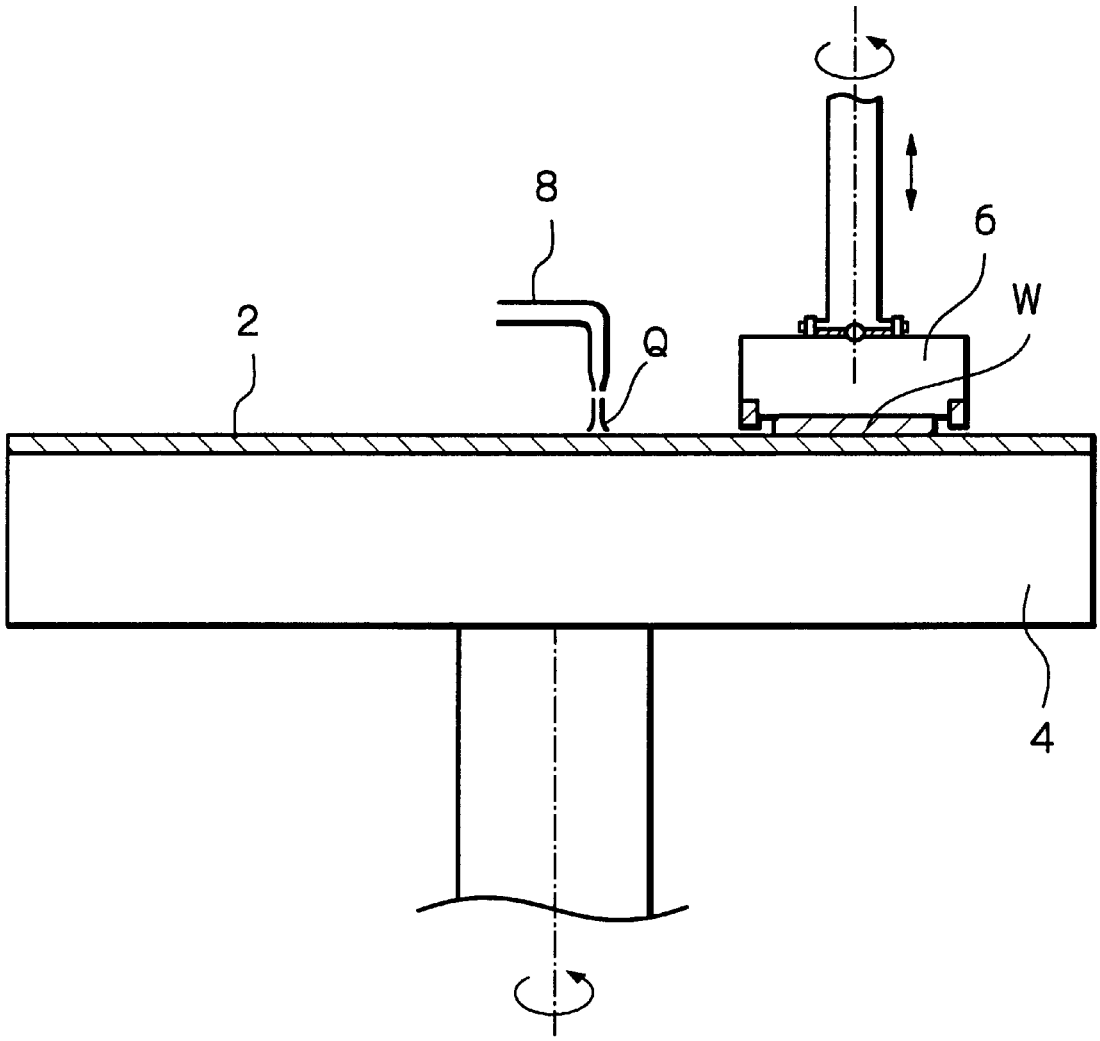
FIG. 1 is a front view showing a general structure of a polishing apparatus.
Figure 2:
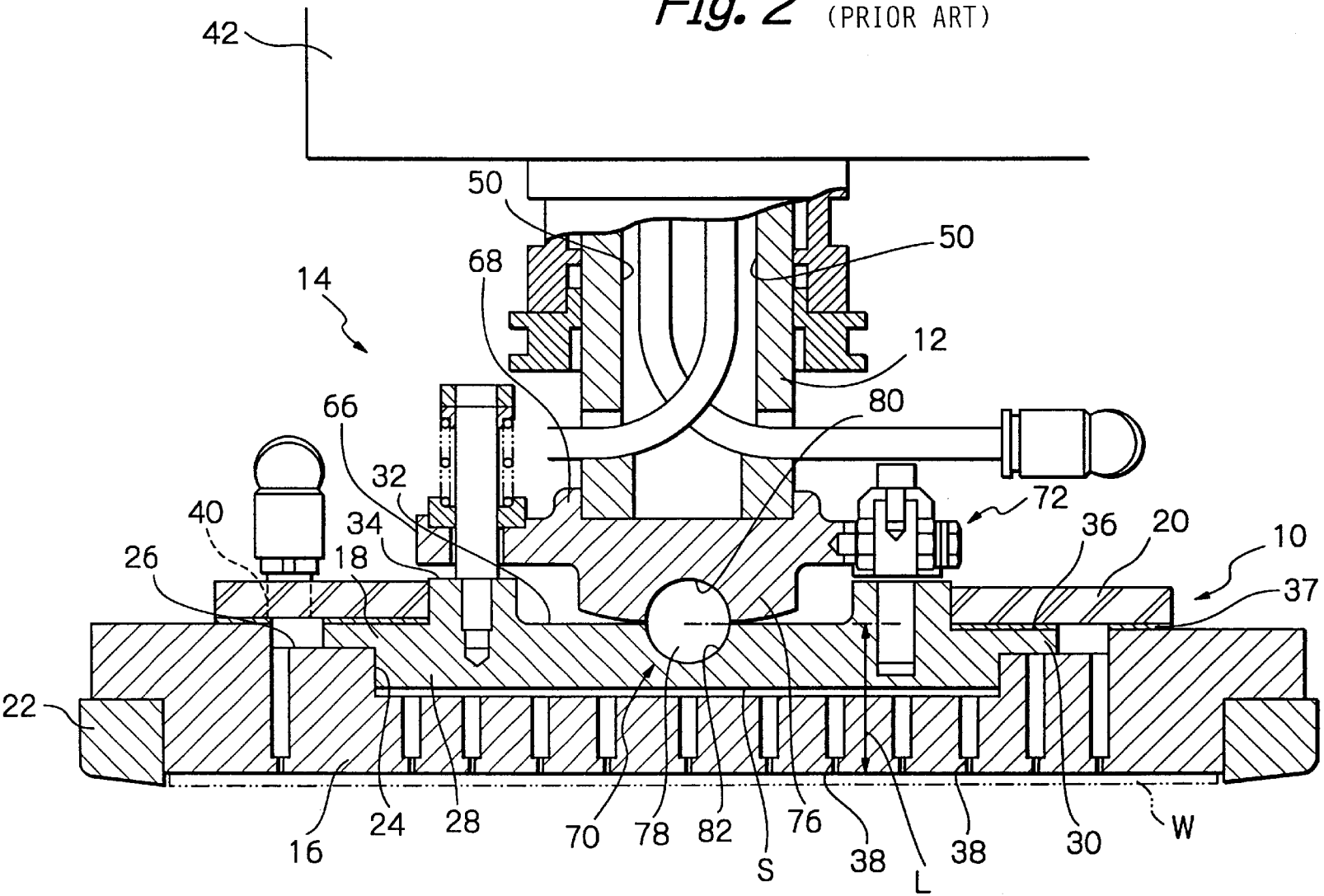
Fig. 2 (PRIOR ART)
FIG. 2 is a sectional view showing the structure of a prior art substrate holding apparatus.
Figure 3:
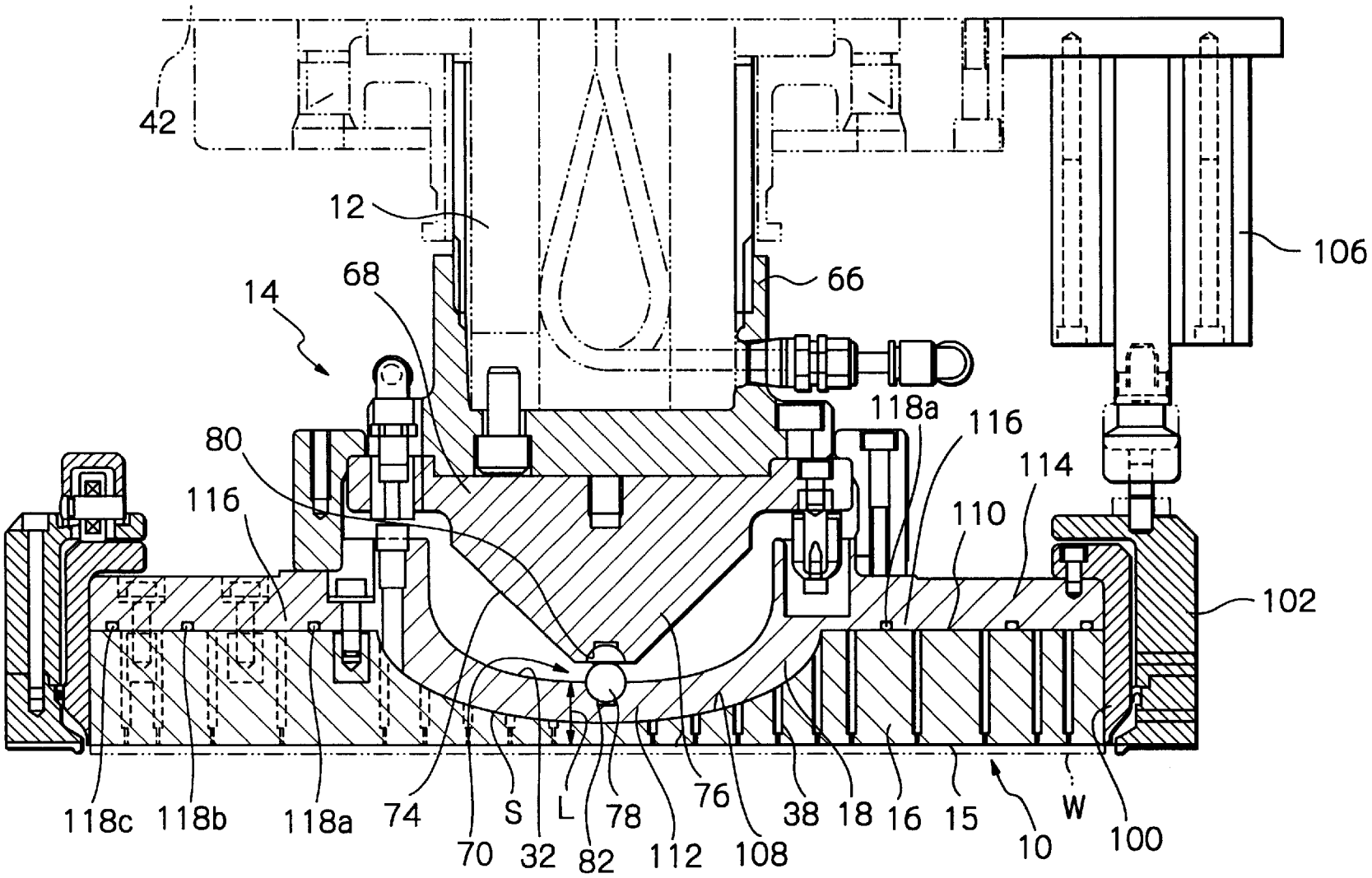
FIG. 3 is a sectional view showing the structure of a substrate holding apparatus according to a first embodiment of the present invention.

FIG. 3 shows a substrate holding apparatus in accordance with an embodiment of this invention. This figure uses the same reference numerals as those used in FIGS. 1 and 2 for the same elements. As shown, the substrate holding apparatus includes a substrate holder 10 which is, as a whole, in the form of a disc, a drive shaft 12 for rotatably driving and urging downwardly the substrate holder 10, and a universal joint 14 for drivingly connecting the substrate holder 10 and the drive shaft 12 while allowing the substrate holder 10 to tilt relative to the drive shaft 12.

The substrate holder 10 includes a substrate holding member 16 in the shape of a disc for holding a substrate on its bottom surface, a cover member 18 placed on and connected to the substrate holding member 16 with a clearance S interposed therebetween. Around the substrate holding member 16 is provided a retainer ring 100 fastened to the cover member 18 with bolts to cooperate with the substrate holding member 16 to define a substrate holding recess. Further, a pressure ring 102 is provided radially outside of the retainer ring 100 and is connected to a head member 42 of the substrate holding apparatus through a plurality of air cylinder devices (only one of which is shown) to be adjustably moved up and down.

The upper surface of the substrate holding member 16 is formed at the center thereof with a recess 108 surrounded by an annular shoulder surface 110. The cover member 18 includes a projected portion 112 provided on the lower surface thereof and inserted into the recess 108 of the substrate holding member 16, and an annular flange portion 114 placed on and fastened to the shoulder surface 110 of the substrate holding member 16. The recess 108 and the projected portion 112 have cross sections, the contours of which are represented substantially by a curve of the second order, in this particular case, an oval curve having a major axis extending along a horizontal plane including the shoulder surface 110 and a minor axis extending vertically through the center of the universal joint.

The lower surface of the peripheral portion or flange portion 114 of the cover member 18 is provided with a plurality of annular projections 116 coaxial with the cover member 18 and engaged with the shoulder surface 110 of the substrate holding member 16 so that the cover member 18 imposes a downward pressure on the substrate holding member 16 through the annular projections 116. The radially inner edge of the innermost one of the annular projections 116 is positioned adjacent to the intersectional area between the shoulder surface 110 and the recess 108. There is provided a clearance S of a predetermined height between the cover member 18 and the substrate holding member 16 in the area inside of the radially innermost annular projection, and the clearance S is sealed to be airtight using a plurality of annular seal rings 118*a*, 118*b* and 118*c* fitted in grooves formed between the adjacent annular projections 116. The clearance S is fluidly connected to a passage (not shown) that is adapted to be connected to an outsiders vacuum supply source and/or a pressurized fluid supply source. The clearance S is also connected to a plurality of stepped through holes 38 provided in the substrate holding member 16 which fluidly connect the clearance S to the upper surface of a substrate W held by the substrate holding member 16.

The drive shaft 12 is supported by a holder head 42 mounted on a strut (not shown) in such a manner that the shaft is rotatable around its axis and movable up and down. Specifically, the drive shaft 12 is drivingly connected to a motor provided with a reduction gear (not shown) through a belt/pulley device, and is also connected to a piston/cylinder device (not shown) interposed between the drive shaft 12 and the holder head 42 so as to be moved up and down. The drive shaft 12 is hollow with tubes made from corrosion-resistant material such as Teflon and polypropylene passing therethrough, and the upper end of the tubes are connected to outside fluid supply sources through a rotary joint structure (not shown).

The drive shaft 12 has a drive member 68 securely mounted on the lower end thereof through a mount member 66. The drive member 68 is provided on its lower surface with a projected portion 76 having a conical surface 74. The projected portion is provided at its center with a hemispherical recess 80 for slidably receiving a ball bearing 78. The cover member 18 has at the center of its upper surface a recess 32 having a sufficient width and depth to receive the projected portion 76 therein. As shown, in this embodiment, the recess 32 is concave or in the form of a curved surface recess similar to the recess 108 formed in the upper surface of the substrate holding member 16. It is preferable that the recess 32 has a vertical cross sectional configuration represented by a curve of the second order. The recess 32 has at the center of its bottom surface a hemispherical recess 82 for slidably receiving the ball bearing 78, whereby a spherical bearing 70 is formed between the drive shaft 12 and the substrate holder 10. In FIG. 3, the substrate holder 10 is suspended from the drive shaft 12, whereby the drive member 68 is lifted relative to the holder 10, with the result that the spherical recess 80 is, as shown, spaced from the ball bearing 78.

In this particular embodiment, the ball bearing 78 is, as a whole, positioned within the recess 108 of the substrate holding member 16 and thus is below the level of the shoulder surface 110. As stated above, the recess 108 provided in the substrate holding member 16 and the projected portion 112 of the cover member 18 have a cross section, the contour of which is represented by a curve of the second order. This.enables the substrate holding member 16 to be made thin as a whole, thereby realizing lightening of the substrate holding member 16 and positioning of the center of the spherical bearing 70 closer to a turntable 4 while maintaining sufficient rigidity in the substrate holding member 16 to prevent it from being deformed. The distance "L" between the center of the ball bearing 78 and the lower surface of the substrate holding member 16 is shortened to 16 mm from 26 mm as measured in the apparatus shown in FIG. 2.

Further, in this particular embodiment, it is designed that a difference between a moment of inertia relative to a reference axis passing through the center of the spherical bearing 70 and a moment of inertia relative to an axis parallel to the reference axis and passing through the center of gravity of a part of the substrate holding apparatus, which is pivotable around the spherical bearing 70 including the substrate holder 10, the retainer ring 100 and parts associated therewith is in the range of ±5% of the latter moment of inertia, thereby ensuring that the substrate holding member 16 is capable of following contours in the surface of a polishing cloth.

In other words, the design is intended to ensure that the center of gravity of the above-stated pivotable part of the substrate holding apparatus generally coincides with that of the spherical bearing 70. This is because a moment of inertia (I) representing a resistance of an article against a torque to rotate the article around a reference axis is calculated from the following equation: $I=I_0+Mh^2$, wherein $I_0$ is a moment of inertia of the article relative to an axis extending through a center of gravity thereof and parallel to the reference axis; M is a mass of the article; and, h is a distance between the reference axis and the axis passing through the center of gravity.

In order to determine advantages of an apparatus in accordance with this invention, comparison with a prior art apparatus of the type as shown in FIG. 2 was conducted by using the so-called finite element method. The conditions applied to those apparatus are as follows:

① To set the spherical bearing at a low position:
The thickness of the center of the substrate holding member 16 is 2 mm.

② To maintain an appropriate rigidity:
The maximum deformation of the substrate holding member 16 is less than 1 $\mu$ when a force of 500 gf/cm$^2$ (49 kPa) is applied to the substrate holding member 16.

③ A substrate to be polished is of a large-size.
It is presumed that a diameter of the substrate is 200 mm.

Figure 4:
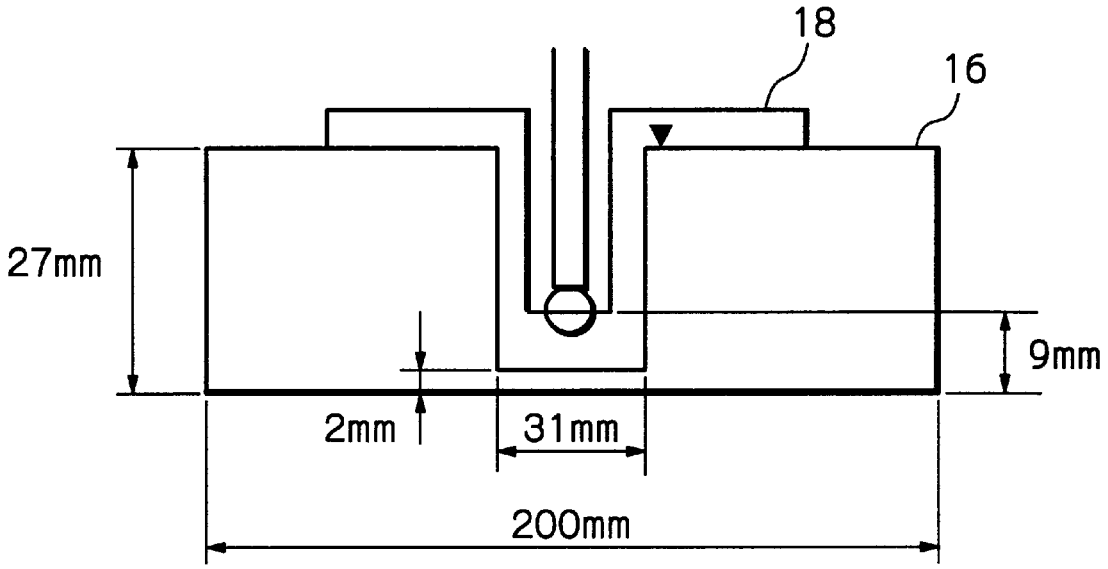
FIG. 4 is a schematic view of a model of a prior art substrate holding apparatus prepared on the basis of a result of a numerical analysis.
Figure 5:
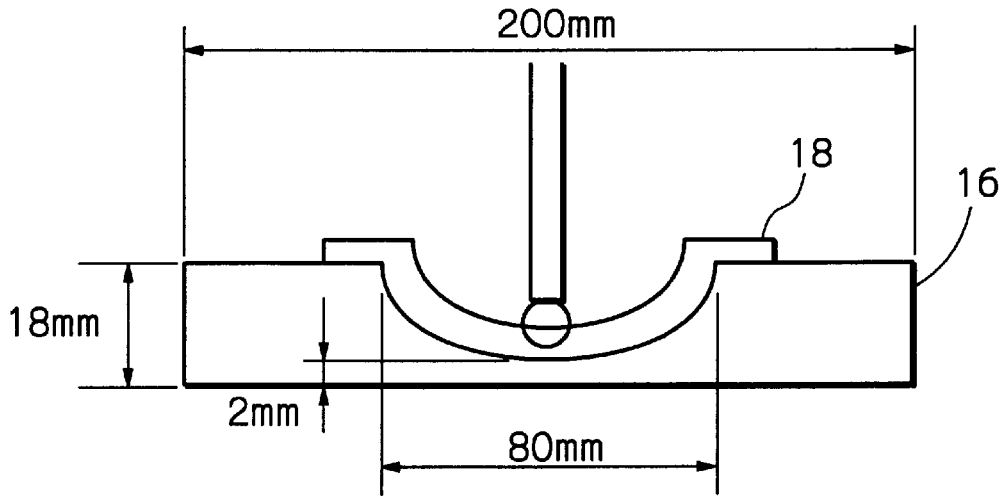
FIG. 5 is a schematic view of a model of a substrate holding apparatus in accordance with this invention prepared on the basis of a numerical analysis.

FIGS. 4 and 5 show schematic diagrams drawn in accordance with results of analysis conducted by the finite element method. As shown, in the prior art apparatus, it is required that the diameter of the center recess formed in the substrate holding member 16 be kept to be less than 31 mm to maintain its appropriate rigidity, and the height or thickness thereof should be 27 mm or more.

In contrast, in the apparatus according to this invention where the substrate holding member 16 has a center recess of a cross section, the contour of which is represented by a curve of the second order, land in the above-described embodiment, an oval curve, it is required that the thickness of the substrate holding member is about 18 mm, whereby lightening of the substrate holding member can be attained. Further, the position of the spherical bearing generally coincides with the center of gravity of the elements including the substrate holding member tilted about the spherical bearing. Furthermore, it has been found that the maximum deformation of the substrate holding member 16 is relatively slight, i.e., 0.537 $\mu$ when 500 gf/cm$^2$ (49 kPa) is applied to the substrate holding member.

Figure 6:
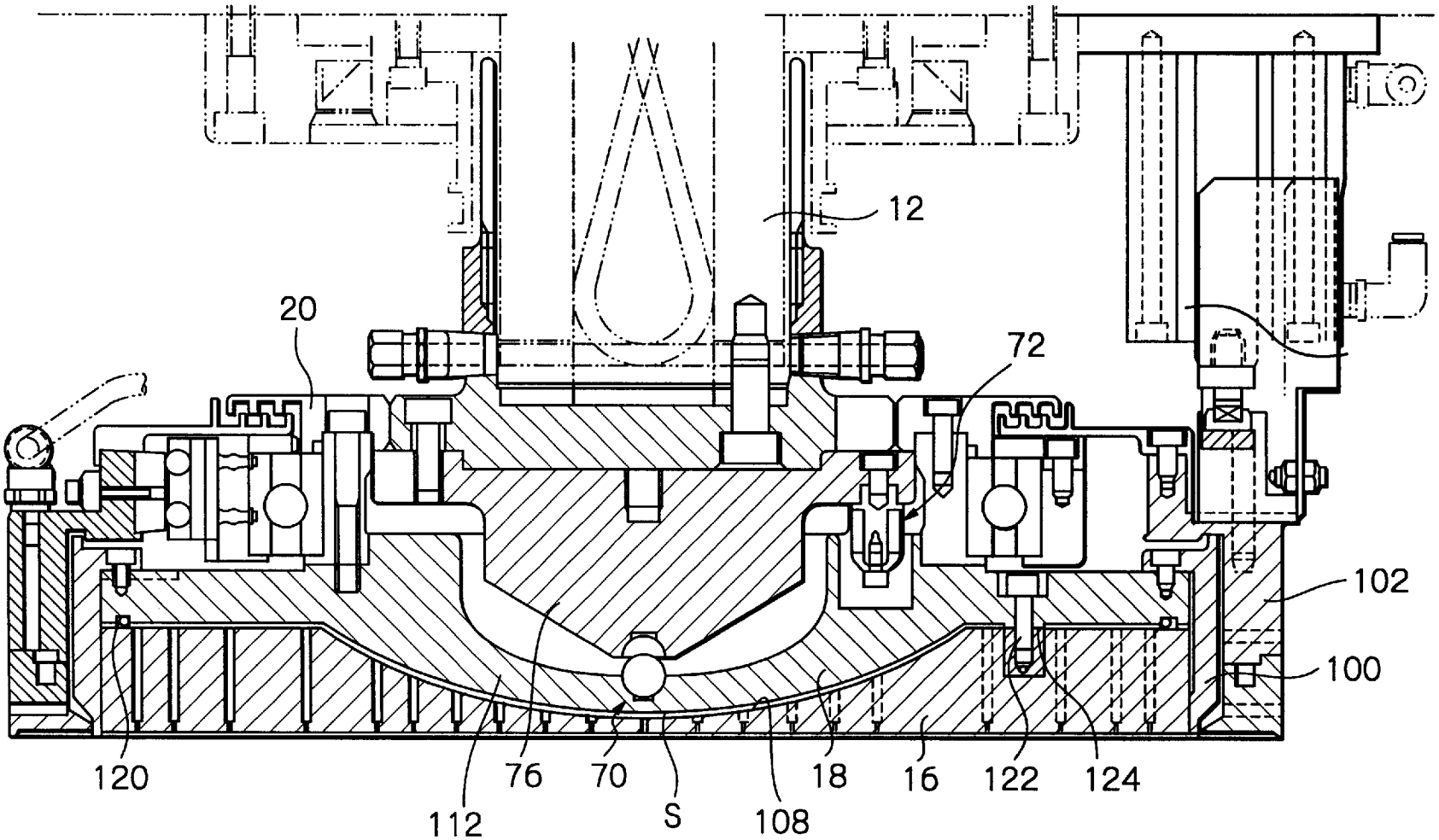
FIG. 6 is a sectional view showing the structure of a substrate holding apparatus according to a second embodiment of the present invention.

FIG. 6 shows another embodiment in accordance with this embodiment in which the recess 108 formed in the upper surface of the substrate holding member 16 is a spherical surface instead of the oval surface in the first embodiment. The substrate holding member 16 and the cover member 18 are fastened to each other by a plurality of, about six, bolts 122 which are circumferentially arranged about the vertical center axis of the substrate holding member, 16. The bolts are, in this embodiment, of M3–M8. The bolts are fastened with a torque in a range of 3 kgf.cm–20 kgf.cm (0.3–2 N.m) to seal the vacuumed clearance S formed between the center recess 108 of the substrate holding member 16 and the projected portion 112 of the cover member 18 from the outside, taking into consideration the squeeze of a seal member 16 interposed between the substrate holding member and the cover member 18. Reference numeral 120 designates a seal ring.

Figure 7:
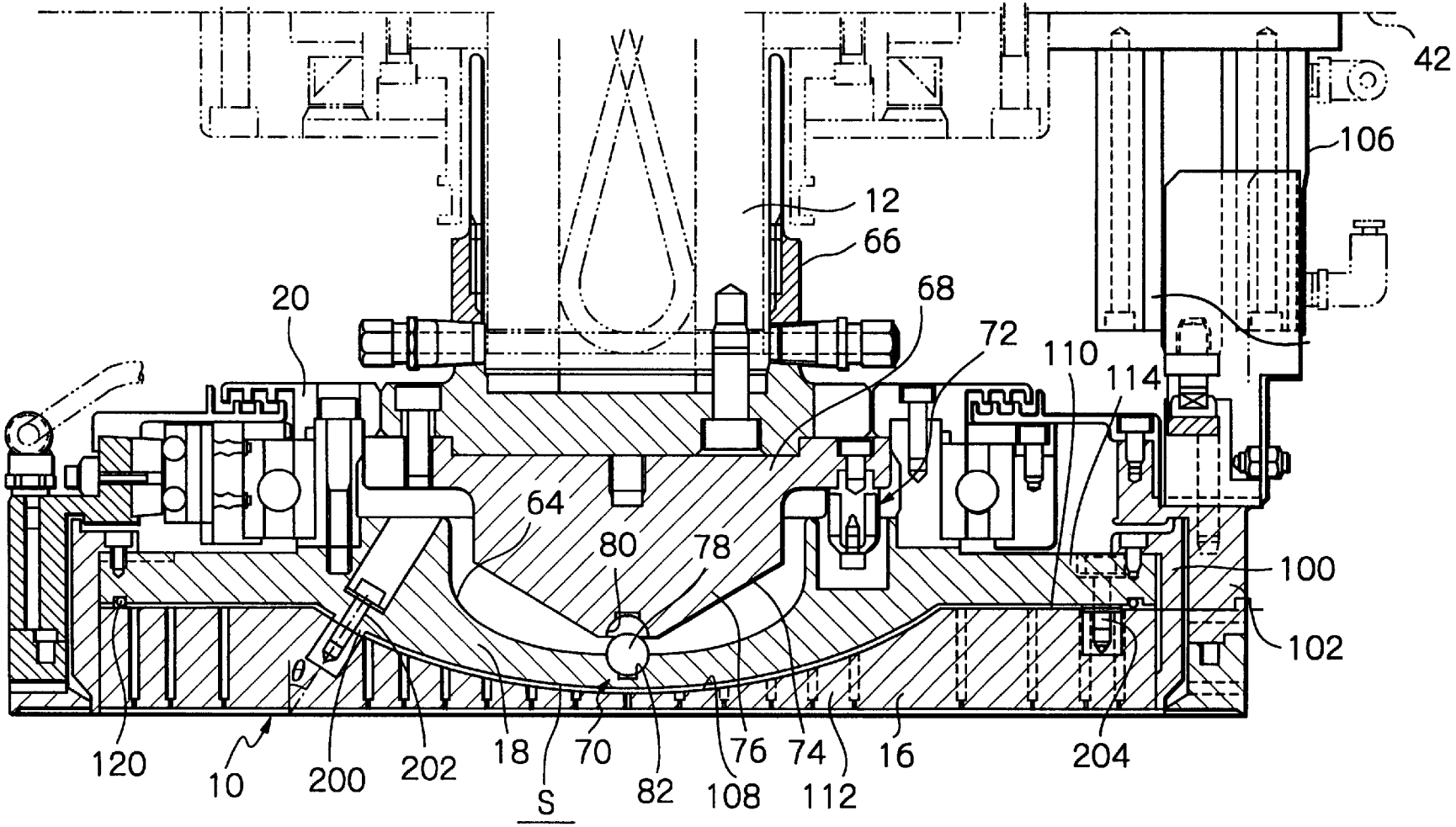
FIG. 7 is a sectional view showing a structure of a substrate holding apparatus in accordance with a third embodiment of this invention.

FIG. 7 shows a substrate holding apparatus in accordance with a third embodiment of this invention in which, taking into consideration the following matters, the substrate holding member 16 and the cover member 18 are fastened by bolts in a way different from that of the other embodiments stated above.

In order to attain a high degree of planarization throughout a polished surface of a substrate, it is necessary that the lower surface of the substrate holding member be kept flat to a high degree. Even if the lower surface is finished with a high degree of flatness, if assembling the substrate holding member with other elements is not appropriately conducted, there is a possibility of deformation of the lower surface of the substrate holding member. Further, such a deformation may be brought about by a force applied to the substrate holding member and/or thermal extension caused by heat generated in a polishing operation. Such a possibility increases as the size of substrates or semiconductor wafers increases.

Figure 8:
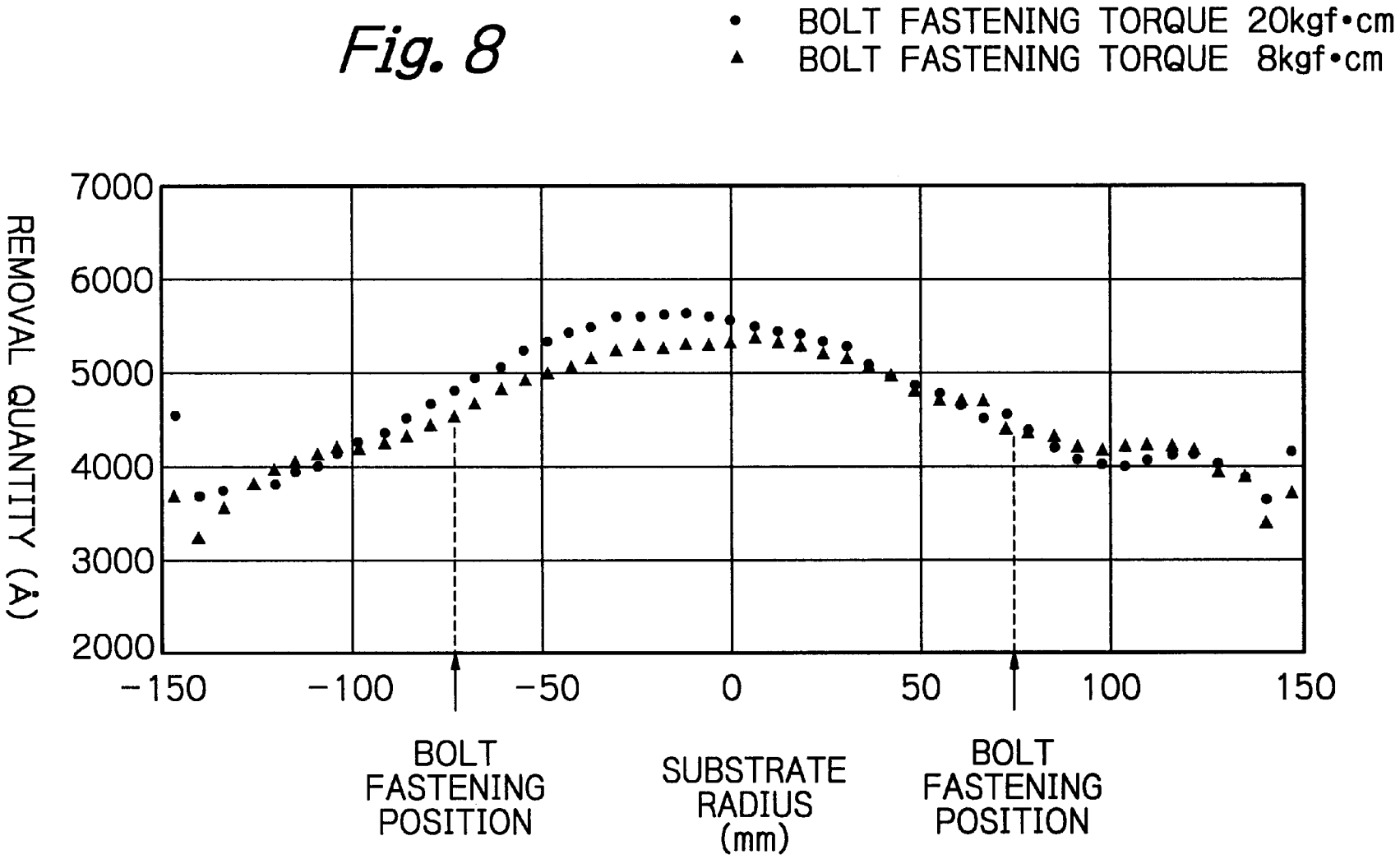
FIG. 8 is a graph showing flatness of surfaces of semiconductor wafers polished by polishing apparatuses each of which has a semiconductor holding apparatus prepared under different conditions.
Figure 9:
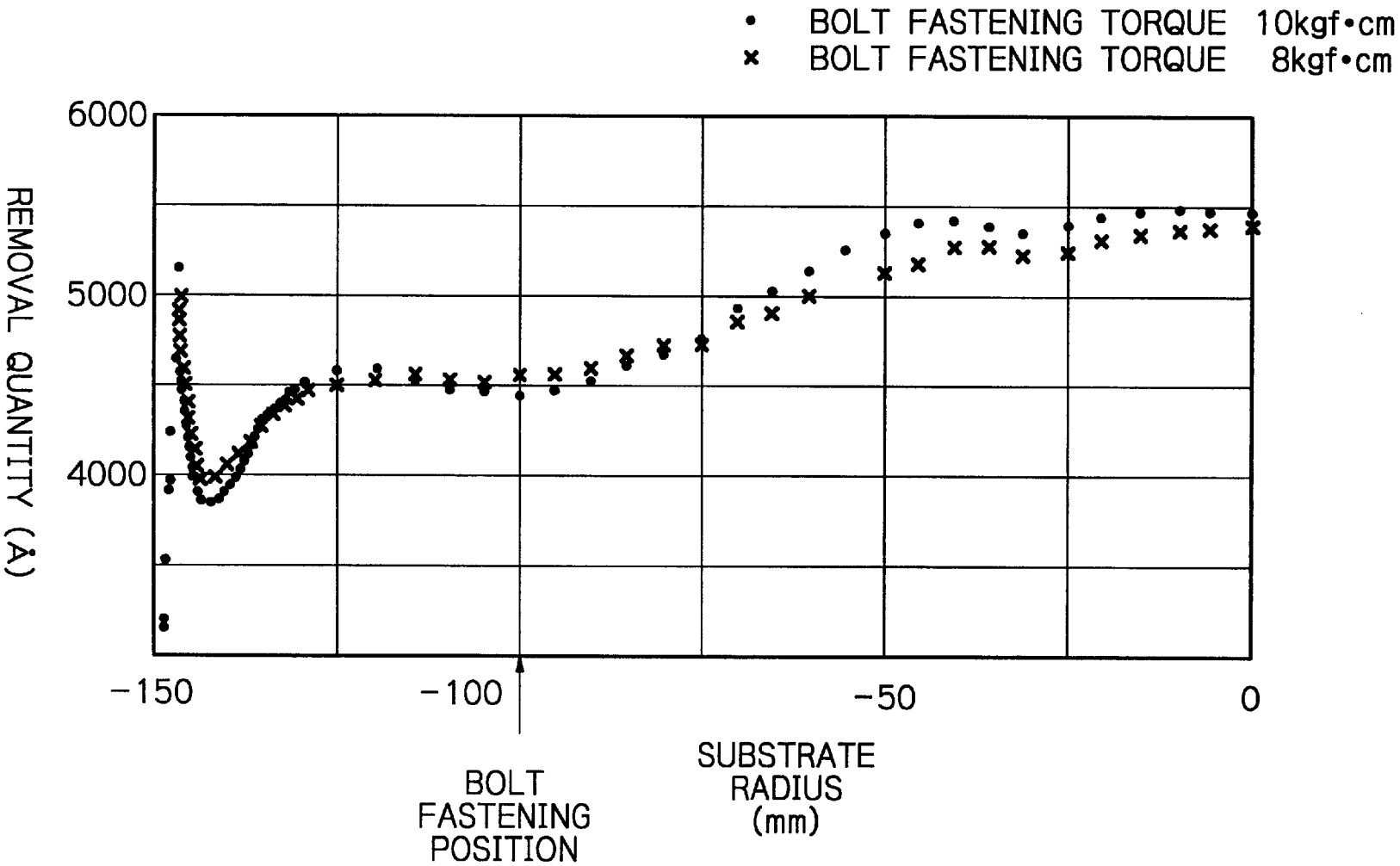
FIG. 9 is a graph showing flatness of surfaces of semiconductor wafers polished by polishing apparatuses each of which has a semiconductor wafer holding apparatus prepared under different conditions from those of the holding apparatus related to FIG. 8.

FIG. 8 shows a degree of flatness of surfaces of two substrates or semiconductor wafers of a diameter of 300 mm polished by two polishing apparatuses with the substrate holding apparatuses as shown in FIG. 7 which were prepared under the following different conditions: although in both apparatuses, the substrate holding member 16 and the cover member 18 were fastened by bolts 122 positioned along a circle of a diameter of 150 mm coaxial with those members, the fastening torques were 20 kgf.cm (2 N.m) in one apparatus and 8 kgf.cm (0.8 N.m) in the other apparatus. A back pressure of 200 gf/cm$^2$ (20 kPa) was applied to the substrates held against the lower surface of the substrate holding member 16 through the clearance S. FIG. 9 shows the degree of flatness of surfaces of two semiconductor wafers of a diameter of 300 mm which were polished under the same conditions as those in FIG. 8 except that in both apparatuses bolts were positioned along a circle of a diameter of 200 mm and the fastening torques were 8 kgf.cm (0.8 N.m) in one apparatus and 10 kgf.cm (1 N.m) in the other apparatus.

From these figures, it should be noted that the greater the fastening torque, the greater the rate of polishing in the center area of a wafer, while in some areas close to the bolts fastened with the smaller torque, a greater polishing rate is shown. Further, it has determined that such a tendency is magnified when a larger diameter wafer is polished. It is considered that this is so, because in a polishing operation a temperature gradient where the temperature in the center area of the substrate holding member is greater than that in the outer area of the same is brought about in addition to the fact that a large diameter substrate holding member can be readily deformed by a fastening force.

Turning to FIG. 7, it should be noted that the apparatus shown therein includes bolts positioned at two radial distance positions: the bolts 202 are arranged in a circle coaxial with and closer to the center axis of the substrate holding member 16 than a coaxial circle along which the bolts 204 are arranged. Specifically, the bolts 202 and 204 are respectively positioned at distances 55% and 91% along a radius as measured from the center of the rotation of the substrate holding member 16 . Incidentally, the fastening bolts 122 in the apparatus shown in FIG. 6 are provided at a distance 61% of the same.

Further, it should be noted that the bolts 202 are tilted at an angle θ relative to a line normal to the lower surface of the substrate holding member 16. The lower surface of the cover member 18 is provided with annular projections 200 that surround the fastening bolts 202 and engage with the surface of the recess 108 of the substrate holding member 16 so that the clearance S remains between the substrate holding member 16 and the cover member 18.

When assembling the substrate holding member 16 and the cover member 18, the inner bolts 202 are first fastened so as to assemble the substrate holding member 16 and the cover member 18 so as to assure an appropriate mechanical connection strength thereof. Thereafter, the outer bolts 204 are fastened so as to adjust the flatness of the lower surface of the substrate holding member 16, taking into consideration various factors as stated above. Even if the lower surface is adjusted to be perfectly flat, flatness may not be maintained during a polishing operation as the substrate holding member 16 is subject to various forces, heat and so on during a polishing operation. As such, the adjustment of the flatness of the lower surface of the substrate holding member 16 by the bolts 204 should be conducted taking into account such factors in advance of a polishing operation. In order to solve such a problem, several apparatus and methods have been presented (for example, Japanese Laid-Open Patent Application H11-25364).

For example, if a substrate to be polished has a metal surface susceptible to the influence of a chemical polishing material supplied during a polishing operation, there will be a tendency for a temperature of the center area of the substrate to increase to a level in excess of that of the peripheral portion thereof and, as a result, the center area is polished excessively. In the case of polishing of such a substrate, the inside bolts 202 should be fastened with a higher torque than the outside bolts 204. In such a way, the lower surface of the substrate holding member 16 is adjusted beforehand so that the temperature gradient as stated above is compensated for and, thus, the pressure between the surface of a substrate held against the lower surface of the substrate holding member 16 and a polishing surface of a turntable is made uniform throughout the entire surface, whereby the surface is polished uniformly.

Such an adjustment of fastening torques will vary depending on characteristics of surfaces of substrates to be polished (e.g., oxide film or metal film), a pressure under which a substrate is urged, aging of a polishing pad on a turntable and so on. The adjustment is conducted on the basis of the estimation of the flatness of the lower surface of the substrate holding member during the polishing operation by checking flatness of polished surfaces of substrates or measurement of the lower surface of a substrate holding member 16 by virtue of a strain sensor provided in connection with the substrate holding member 16. In the embodiment shown in FIG. 7, two sets of bolts are provided along coaxial inside and outside circles relative to the center axis of the substrate holding member 16, and the adjustment of the lower surface of the substrate holding member 16 can be readily and numerically controllably effected.

The bolts 202 are tilted, thereby bringing about the following advantages as compared with vertically fastened bolts in prior art apparatuses: (1) the bolts can be made long enough to increase mechanical connection strength between the substrate holding member and the cover member; (2) stresses caused by tightening the bolts will exert less influence on the substrate holding member; (3) while in a prior art apparatus bolts are provided parallel to the axis of rotation of the substrate holder and thus the bolts tend to be loosened as time passes, the tilted bolts have no such problem; and (4) since a plurality of vertical bolts and tilted bolts fasten the substrate holding member 16 to the cover member 18 with forces in different directions, these members are firmly fastened together. Although the embodiment shown in FIG. 7 includes two sets of the bolts, or the inside and outside bolts arranged along coaxial circles, three or more sets of bolts can be employed.

Further, since the substrate holding member 16 and the cover member 18 abut on or are in contact with each other through inclined projections 200, it is possible to make the contact area between these members larger, whereby effective heat transfer from the substrate holding member 16 to the cover member 18 can be attained and thus the temperature gradient generated in the substrate holding member 16 can be reduced.

It should be noted that the present invention is not necessarily limited to the foregoing embodiments but can be modified in a variety of ways without departing from the gist of the present invention.

What is claimed is:

1. A substrate holding apparatus comprising:

a substrate holder for holding a substrate to be polished and urging the substrate against a polishing surface, with said substrate holder having an axis for rotation;

a drive shaft for drivingly rotating said substrate holder about said axis for rotation; and a joint for connecting said substrate holder to said drive shaft in such a manner that said substrate holder can tilt relative to said drive shaft;

wherein said substrate holder includes (i) a substrate holding member having a lower surface for holding the substrate and an upper surface defining a curved recess, with said upper surface including a bottom portion that defines a bottom of said curved recess; and (ii) a cover member secured to said substrate holding member, with said cover member having a lower surface with a protrusion extending therefrom which is received within said curved recess, and also having an upper surface having a cavity therein which extends towards said protrusion, with said cavity having a bottom surface through which said axis for rotation vertically extends;

wherein said joint is provided at said bottom surface of said cavity;

wherein said bottom of said curved recess is a central bottom portion and corresponds to a deepest portion of said curved recess; and wherein said cavity extends into said protrusion such that said bottom surface of said cavity is positioned below the level of said upper surface of said substrate holding member.

2. A substrate holding apparatus comprising:

a substrate holder for holding a substrate to be polished and urging the substrate against a polishing surface, with said substrate holder having an axis for rotation;

a drive shaft for drivingly rotating said substrate holder about said axis for rotation; and a joint for connecting said substrate holder to said drive shaft;

wherein said substrate holder includes (i) a substrate holding member having an upper surface and a lower surface for holding the substrate; and (ii) a cover member having a lower surface engaged with said upper surface of said substrate holding member, and also having an upper surface connected to said joint;

with said lower surface of said cover member being engaged with said upper surface of said substrate holding member by having said substrate holding member and said cover member be fastened to one another via bolts which are provided at a plurality of different radial distances from said axis for rotation.

3. The substrate holding apparatus according to claim 2, wherein said joint connects said substrate holder to said drive shaft in such a manner that said substrate holder can tilt relative to said drive shaft, and said bolts comprise a first set of bolts which are arranged along a first circle that is coaxial with said axis for rotation and also comprise a second set of bolts which are arranged along a second circle that is coaxial with and radially outside of said first circle.

4. The substrate holding apparatus according to claim 3, wherein said first set of bolts are arranged at a predetermined interval along said first circle and said second set of bolts are arranged at a predetermined interval along said second circle.

5. The substrate holding apparatus according to claim 4, wherein said bolts of at least one of said first and second sets are inclined from a vertical orientation.

6. The substrate holding apparatus according to claim 5, wherein said bolts of said first set are inclined from the vertical orientation.

7. The substrate holding apparatus according to claim 3, wherein said bolts of at least one of said first and second sets are inclined from a vertical orientation.

8. The substrate holding apparatus according to claim 7, wherein said bolts of said first set are inclined from the vertical orientation.

9. The substrate holding apparatus according to claim 7, wherein said upper surface of said substrate holding member defines a curved recess, wherein said lower surface of said cover member has a protrusion extending therefrom, with a configuration of said protrusion being complementary to a configuration said curved recess, and wherein the bolts that are inclined from the vertical orientation are radially spaced from said axis for rotation a distance that is less than a radius of said curved recess and extend substantially normal to opposing surfaces of said curved recess and said protrusion.

10. The substrate holding apparatus according to claim 3, wherein said bolts of one of said first and second sets are tightened with a torque to provide an appropriate mechanical connection between said substrate holding member and said cover member and said bolts of the other of said first and second sets are tightened so as to adjust flatness of said lower surface of said substrate holding member.

11. The substrate holding apparatus according to claim 10, wherein said bolts of said first set are tightened with a torque to provide an appropriate mechanical connection between said substrate holding member and said cover member, and said bolts of said second set are tightened so as to adjust flatness of said lower surface of said substrate holding member.

12. The substrate holding apparatus according to claim 4, wherein said upper surface of said substrate holding member defines a curved recess, with said upper surface including a bottom portion that defines a bottom of said curved recess, wherein said lower surface of said cover member has a protrusion extending therefrom which is received within said curved recess, wherein said upper surface of said cover member has a cavity therein which extends towards said protrusion, with said cavity having a bottom surface through which said axis for rotation vertically extends, and wherein said joint is provided at said bottom surface of said cavity.

13. The substrate holding apparatus according to claim 12, wherein said bottom of said curved recess is a central bottom portion and corresponds to a deepest portion of said curved recess.

14. The substrate holding apparatus according to claim 13, wherein said cavity extends into said protrusion such that said bottom surface of said cavity is positioned below the level of said upper surface of said substrate holding member.

15. The substrate holding apparatus according to claim 13, wherein said curved recess has a cross sectional configuration represented by a curve of the second order.

16. The substrate holding apparatus according to claim 15, wherein said curve of the second order is an oval curve.

17. The substrate holding apparatus according to claim 13, wherein said curved recess has a spherical configuration.

18. The substrate holding apparatus according to claim 13, wherein a difference between a moment of inertia relative to a reference axis passing through said joint and a moment of inertia relative to an axis parallel to said reference axis and passing through the center of gravity of said substrate holder is within the range of ±5% of the latter mentioned moment of inertia.

19. The substrate holding apparatus according to claim 13, wherein said protrusion has a complementary configuration to that of said curved recess.

20. The substrate holding apparatus according to claim 4, wherein said bolts of one of said first and second sets are tightened with a torque to provide an appropriate mechanical connection between said substrate holding member and said cover member, and said bolts of the other of said first and second sets are tightened so as to adjust flatness of said lower surface of said substrate holding member.

21. The substrate holding apparatus according to claim 20, wherein said upper surface of said substrate holding member defines a curved recess, wherein said lower surface of said cover member has a protrusion extending therefrom, with a configuration of said protrusion being complementary to a configuration said curved recess, and wherein the bolts that are inclined from the vertical orientation are radially spaced from said axis for rotation a distance that is less than a radius of said curved recess and extend substantially normal to opposing surfaces of said curved recess and said protrusion.

22. The substrate holding apparatus according to claim 5, wherein said upper surface of said substrate holding member defines a curved recess, wherein said lower surface of said cover member has a protrusion extending therefrom, with a configuration of said protrusion being complementary to a configuration said curved recess, and wherein the bolts that are inclined from the vertical orientation are radially spaced from said axis for rotation a distance that is less than a radius of said curved recess and extend substantially normal to opposing surfaces of said curved recess and said protrusion.

23. The substrate holding apparatus according to claim 2, wherein at least some of said bolts are inclined from a vertical orientation.

24. The substrate holding apparatus according to claim 23, wherein the bolts that are radially closest to said axis for rotation are inclined from the vertical orientation.

25. The substrate holding apparatus according to claim 23, wherein said upper surface of said substrate holding member defines a curved recess, wherein said lower surface of said cover member has a protrusion extending therefrom, with a configuration of said protrusion being complementary to a configuration said curved recess, and wherein the bolts that are inclined from the vertical orientation are radially spaced from said axis for rotation a distance that is less than a radius of said curved recess and extend substantially normal to opposing surfaces of said curved recess and said protrusion.

26. The substrate holding apparatus according to claim 2, wherein a first sub-set of said bolts are tightened with a torque to provide an appropriate mechanical connection between said substrate holding member and said cover member, and a second sub-set of said bolts are tightened so as to adjust flatness of said lower surface of said substrate holding member.

27. The substrate holding apparatus according to claim 26, wherein said first sub-set of bolts corresponds to the bolts that are radially closest to said axis for rotation and said second sub-set of bolts corresponds to the bolts that are radially furthest from said axis for rotation.

28. The substrate holding apparatus according to claim 2, wherein said upper surface of said substrate holding member defines a curved recess, with said upper surface including a bottom portion that defines a bottom of said curved recess, wherein said lower surface of said cover member has a protrusion extending therefrom which is received within said curved recess, wherein said upper surface of said cover member has a cavity therein which extends towards said protrusion, with said cavity having a bottom surface through which said axis for rotation vertically extends, and wherein said joint is provided at said bottom surface of said cavity.

29. The substrate holding apparatus according to claim 28, wherein said bottom of said curved recess is a central bottom portion and corresponds to a deepest portion of said curved recess.

30. The substrate holding apparatus according to claim 29, wherein said cavity extends into said protrusion such that said bottom surface of said cavity is positioned below the level of said upper surface of said substrate holding member.

31. The substrate holding apparatus according to claim 29, wherein said curved recess has a cross sectional configuration represented by a curve of the second order.

32. The substrate holding apparatus according to claim 31, wherein said curve of the second order is an oval curve.

33. The substrate holding apparatus according to claim 29, wherein said curved recess has a spherical configuration.

34. The substrate holding apparatus according to claim 29, wherein a difference between a moment of inertia relative to a reference axis passing through said joint and a moment of inertia relative to an axis parallel to said reference axis and passing through the center of gravity of said substrate holder is within the range of ±5% of the latter mentioned moment of inertia.

35. A substrate holding apparatus comprising:

a substrate holder for holding a substrate to be polished and urging the substrate against a polishing surface, with said substrate holder having an axis for rotation;

a drive shaft for drivingly rotating said substrate holder about said axis for rotation; and a joint for connecting said substrate holder to said drive shaft;

wherein said substrate holder includes (i) a substrate holding member having an upper surface and a lower surface for holding the substrate; and (ii) a cover member having a lower surface opposing said upper surface of said substrate holding member, and also having an upper surface connected to said joint;

with said substrate holding member and said cover member being fastened to one another via bolts which are provided at a plurality of radial distances from said axis for rotation, with at least some of said bolts being inclined from a vertical orientation.

36. The substrate holding apparatus according to claim 35, wherein said upper surface of said substrate holding member defines a curved recess, wherein said lower surface of said cover member has a protrusion extending therefrom, with a configuration of said protrusion being complementary to a configuration said curved recess, wherein the bolts that are inclined from the vertical orientation are arranged along a circle having a diameter which is smaller than a diameter of said curved recess and extend substantially normal to opposing surfaces of said curved recess and said protrusion, and wherein said protrusion has projections extending therefrom which surround the inclined bolts, respectively, and which also abut a surface of said curved recess such that a clearance is formed between the opposing surfaces of said curved recess and said protrusion.

37. The substrate holding apparatus according to claim 36, wherein said projections are cylindrical in shape.

38. A substrate holding apparatus comprising:

a substrate holder for holding a substrate to be polished and urging the substrate against a polishing surface, with said substrate holder having an axis for rotation and an upper surface defining a first concave recess, with said upper surface including a bottom portion that defines a bottom of said first concave recess;

a second concave recess formed in said bottom portion;

a drive shaft for drivingly rotating said substrate holder about said axis for rotation; and a joint for connecting said substrate holder to said drive shaft, with said joint being provided at said second concave recess and entirely within said first concave recess such that said joint is in its entirety positioned below the level of the upper surface of said substrate holder.

39. The substrate holding apparatus according claim 38, wherein said joint is for connecting said substrate holder to said drive shaft such that said substrate holder can tilt relative to said drive shaft.

40. The substrate holding apparatus according to claim 38, wherein said first concave recess has a portion that continually slopes away from said bottom of said first concave recess toward an upper level of said first concave recess.

41. The substrate holding apparatus according to claim 40, wherein said joint is for connecting said substrate holder to said drive shaft such that said substrate holder can tilt relative to said drive shaft.

42. The substrate holding apparatus according to claim 38, wherein said first concave recess has a cross sectional configuration represented by a curve of the second order.

43. The substrate holding apparatus according to claim 42, wherein said curve of the second order is an oval curve.

44. The substrate holding apparatus according to claim 43, wherein said joint is for connecting said substrate holder to said drive shaft such that said substrate holder can tilt relative to said drive shaft.

45. The substrate holding apparatus according to claim 42, wherein said joint is for connecting said substrate holder to said drive shaft such that said substrate holder can tilt relative to said drive shaft.

46. A substrate holding apparatus comprising:

a substrate holder for holding a substrate to be polished and urging the substrate against a polishing surface, with said substrate holder having an axis for rotation;

a drive shaft for drivingly rotating said substrate holder about said axis for rotation; and a joint for connecting said substrate holder to said drive shaft in such a manner that said substrate holder can tilt relative to said drive shaft;

wherein said substrate holder includes (i) a substrate holding member having a lower surface for holding the substrate and an upper surface defining a curved recess, with said upper surface including a bottom portion that defines a bottom of said curved recess; and (ii) a cover member secured to said substrate holding member, with said cover member having a lower surface with a protrusion extending therefrom which is received within said curved recess, and also having an upper surface having a cavity therein which extends towards said protrusion, with said cavity having a bottom surface through which said axis for rotation vertically extends;

wherein said joint is provided at said bottom surface of said cavity;

wherein said bottom of said curved recess is a central bottom portion and corresponds to a deepest portion of said curved recess; and wherein a difference between a moment of inertia relative to a reference axis passing through said joint and a moment of inertia relative to an axis parallel to said reference axis and passing through the center of gravity of said substrate holder is within the range of ±5% of the latter mentioned moment of inertia.

47. A substrate holding apparatus comprising:

a substrate holder for holding a substrate to be polished and urging the substrate against a polishing surface, with said substrate holder having an axis for rotation;

a drive shaft for drivingly rotating said substrate holder about said axis for rotation; and a joint for connecting said substrate holder to said drive shaft in such a manner that said substrate holder can tilt relative to said drive shaft;

wherein said substrate holder includes (i) a substrate holding member having a lower surface for holding the substrate and an upper surface defining a curved recess, with said upper surface including a bottom portion that defines a bottom of said curved recess; and (ii) a cover member secured to said substrate holding member, with said cover member having a lower surface with a protrusion extending therefrom which is received within said curved recess, and also having an upper surface having a cavity therein which extends towards said protrusion, with said cavity having a bottom surface through which said axis for rotation vertically extends;

wherein said joint is provided at said bottom surface of said cavity;

wherein said bottom of said curved recess is a central bottom portion and corresponds to a deepest portion of said curved recess; and wherein said protrusion has a complementary configuration to that of said curved recess.

48. The substrate holding apparatus according to claim 11, wherein said protrusion has a complementary configuration to that of said curved recess.

* * * * *